US005816578A

United States Patent [19]

Frankamp et al.

[11] Patent Number: 5,816,578

[45] Date of Patent: Oct. 6, 1998

[54] ARCADE ROPING GAME AND ROPING TRAINING APPARATUS

[76] Inventors: Dale Frankamp, 1317 17th St., Belleville, Kans. 66935; Paul Frankamp, 729 S. Nicollet St., Blue Earth, Minn. 56013

[21] Appl. No.: 835,822

[22] Filed: Apr. 16, 1997

[51] Int. Cl.[6] ..... A63B 67/00; A63B 69/00

[52] U.S. Cl. ..... 273/367; 273/371

[58] Field of Search ..... 273/336, 337, 273/338, 339, 359, 366, 367, 368, 369, 370, DIG. 26; 463/58, 59, 60, 61, 62, 66, 67, 68

[56] References Cited

U.S. PATENT DOCUMENTS

| | | | |
|---|---|---|---|
| 1,668,389 | 5/1928 | Vigneron | 273/DIG. 26 |
| 2,687,304 | 8/1954 | Northrop et al. | 463/62 |
| 3,406,969 | 10/1968 | Tisdell et al. | 273/366 |
| 3,802,706 | 4/1974 | Hamm . | |
| 3,834,702 | 9/1974 | Bliss | 463/67 X |
| 3,947,033 | 3/1976 | Bennett . | |
| 3,970,309 | 7/1976 | Sato | 463/59 |
| 4,136,874 | 1/1979 | McCord . | |
| 4,165,712 | 8/1979 | Crowley, Jr. . | |
| 4,268,037 | 5/1981 | McKinley et al. . | |
| 4,364,570 | 12/1982 | Hallam . | |
| 4,451,045 | 5/1984 | Fesmire . | |
| 4,470,373 | 9/1984 | Kesler . | |
| 4,498,676 | 2/1985 | Runner . | |
| 4,640,515 | 2/1987 | Rhine . | |
| 4,662,642 | 5/1987 | Archibald et al. . | |
| 4,830,379 | 5/1989 | Richard et al. . | |
| 4,874,179 | 10/1989 | Henderson . | |
| 4,960,076 | 10/1990 | Snorgrass et al. . | |
| 4,981,302 | 1/1991 | Narramore . | |
| 4,995,618 | 2/1991 | Panzner . | |
| 5,009,432 | 4/1991 | Richard . | |
| 5,192,210 | 3/1993 | Thomas et al. . | |
| 5,568,926 | 10/1996 | Kaptein . | |
| 5,618,233 | 4/1997 | Iimura et al. | 463/67 |

*Primary Examiner*—William H. Grieb
*Attorney, Agent, or Firm*—Jeffrey L. Thompson; Thompson & Thompson, P.A.

[57] ABSTRACT

An arcade roping game and roping training apparatus having a mechanically movable steer that moves around a track on a game table. The game includes an automatic timer arrangement to measure the length of time from when the steer rounds a corner of the game table to when a player successfully ropes the steer and wraps the rope around a dally horn at the player's corner of the table. The dally horn has an electric switch which is triggered to stop the timer when the player's rope is wrapped around the dally horn. A dally horn is supported over the track at each corner of the game table by an arch structure. The arch structure prevents a player from roping the steer before the player's timer starts. The shape of the game table and the arch structures at each corner simulate a popular roping competition where a steer is turned 90 degrees just before its rear legs are roped. A sound system is provided for making a beep when the steer rounds a corner and the timer starts, for playing a first tune when a player successfully ropes the steer, and for playing a second tune when a player fails to rope the steer before it reaches the next corner.

33 Claims, 10 Drawing Sheets

ARCADE ROPING GAME AND ROPING TRAINING APPARATUS

FIELD OF THE INVENTION

The present invention relates generally to roping games and practice devices and, in particular, to an arcade table or floor roping game and roping training apparatus having a mechanically movable object, an automatic timer, a novel track assembly, and other novel features to enhance a player's roping experience and enjoyment.

BACKGROUND OF THE INVENTION

Roping is a practical skill required in the ranching industry, and steer and calf roping survive today as popular spectator and participation sports. Both amateur and professional rodeos include various types of roping competitions. Calf roping and various types of steer roping are all popular rodeo events.

For example, dally team roping is a popular steer roping competition in modern rodeos. In dally team roping, a team of riders consisting of a header and a heeler cooperate to rope the horns and rear legs of a steer as the steer runs along the rodeo arena. The competition starts with the steer in a center chute with the header positioned on the left-hand side of the steer and the heeler positioned on the right-hand side. When the steer is released and runs from the chute, the header and heeler follow the steer out into the arena until the header ropes the steer about its horns and then turns the steer approximately 90 degrees to the left. This 90 degree turn to the left allows the heeler to turn his horse in behind the steer to a proper roping position. Once in the roping position, the heeler ropes the rear legs of the steer. Both the header and heeler wrap their ropes around a dally horn on the front of their respective saddles upon roping the steer and then stretch the steer between their two horses.

To develop, improve, and maintain roping skills, ropers engage in regular practice. The traditional training technique was to repeat each maneuver with live animals, thereby requiring the use of a horse, a number of calves or steers, and a rather large pen or arena and a suitable chute for the calves or steers. Various helpers or assistants may also be required to assist in preparing the arena and the cattle for the practice. Consequently, the time and expense involved in roping practice using live animals can be quite considerable.

Although various mechanical devices have been previously proposed for use in practicing the art of roping, such devices have various limitations and disadvantages. Moreover, such devices were generally not suitable for use in an arcade environment by novice ropers.

For example, an early mechanical roping training method was to simply have the trainee stand on the ground and practice roping a stationary practice dummy. The stationary dummy was sometimes in the form of a simulated animal with an electric motor to pivot the simulated animal's rear legs back and forth. Although these training techniques were relatively inexpensive, they were also unrealistic in that the practice dummy was not moving away from the roper and there was no time pressure on the roper.

A more recent training method employed a practice dummy which was pulled or otherwise propelled so that the rider could follow along behind the dummy to practice roping. Although this method provided a more realistic training environment than a stationary practice dummy, it did not provide a training technique that allowed more than one person at a time to practice roping, it did not have a system for tracking the roping time of the ropers, and it did not provide a competitive and enjoyable environment for practicing roping. Moreover, this training method was not suitable for use in an arcade environment.

A roping game has also previously been demonstrated at rodeos in the United States. This roping game was a simple arrangement that had a movable practice dummy that moved only a short distance. This game did not have a system for automatically determining a roping time for each player, nor did it have a closed-loop path around which the practice dummy traveled. The game also did not have a construction that prevented premature roping of the practice dummy (i.e., cross-fire). In a crude attempt to provide some competition with the game, the game operator held a timer in his hand and started and stopped the timer manually while observing each player's performance. However, the game resulted in a lot of human error in determining each player's time, and many ropers would leave the game with a feeling that they were treated unfairly by the timer.

SUMMARY OF THE INVENTION

It is therefore an object of the present invention to provide an arcade roping game and roping training apparatus that solves the problems associated with the conventional roping games and practice devices described above.

It is a further object of the present invention to provide an arcade roping game and practice device that simulates many of the characteristics of a rodeo roping event.

It is a further object of the present invention to provide an arcade roping game and practice device that tracks a player's time and performance automatically and accurately.

It is a further object of the present invention to provide an arcade roping game and practice device having an improved shape and design to enhance a player's enjoyment, as well as improve the player's roping skills.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

According to one broad aspect of the present invention, in order to solve the problems described above, a roping game and practice device is provided comprising a movable object adapted to be roped, a timer for determining the length of time a player takes to rope the movable object, a first switch for starting the timer, and a second switch for stopping the timer, the second switch being responsive to a player's rope being wrapped around a dally horn to stop the timer.

According to another aspect of the present invention, a roping game and practice device is provided comprising a movable object adapted to be roped, and a closed-loop path around which the movable object travels, the closed-loop path having at least one corner for making the movable object change a direction of movement abruptly.

According to yet another aspect of the present invention, a roping game and practice device is provided comprising a movable object adapted to be roped, a closed-loop path about which the movable object travels, and an audio means for automatically making a first selected sound when a player successfully ropes the movable object, and for automatically making a second selected sound if a player fails to rope the movable object within a predetermined time or distance of movement.

A preferred embodiment of the present invention provides an arcade roping game and roping training apparatus having a mechanically movable steer or other object that moves around a closed-loop path on a game table or on a floor. The roping game includes an automatic timer arrangement for measuring a length of time from when the steer rounds a corner of the game to when a player at that corner successfully ropes the steer and wraps the rope around a dally horn. The dally horns at each corner of the game are provided with an electric switch which is triggered to stop the timer when the player's rope is wrapped around the dally horn. An electric switch is also provided at each corner of the game to automatically start the timer for each player when the steer rounds the corner and becomes available for the player to rope.

The dally horns are supported over the track at each corner of the game by arch structures. The arch structures prevent the players from roping the steer before the player's timer starts and also help to simulate a rodeo roping event where a steer is turned 90 degrees just before its rear legs are roped.

A sound system is provided for making a sound when each player's timer starts, for playing a first tune when a player successfully ropes the steer, and for playing a second tune when a player fails to rope the steer before it reaches the next corner. A controller is also provided for counting a number of times the steer travels around the track, and for stopping the movable object after the movable object travels around the track a predetermined number of times. The controller can be reset by a coin counter, a key switch, or other suitable means.

An arrangement can also be provided for causing the steer to hop with its rear legs moving in an up-and-down manner while the steer travels around the closed-loop path of the game. The steer is preferably supported by a wheeled trolley having a drive motor for driving a drive wheel in engagement with a track on the game table. The trolley preferably has a pair of wheels that engage a lower track and a single wheel that engages an upper track, and a structure for biasing the upper and lower wheels into engagement with the upper and lower tracks.

A slip ring assembly is positioned in an approximate center of the closed-loop track on the game table for supplying electric power to the trolley. A guiding arrangement extends between the slip ring assembly and the wheeled trolley for guiding the wheeled trolley around the closed-loop track.

The rear legs of the steer are preferably pivotally mounted to the body of the steer so as to pivot rearwardly when a player's rope is looped around the rear legs and pulled tight. The rear legs are spring biased to pivot the rear legs to a forward position when the player's rope is slipped off.

Several other novel features of the present invention are set forth in the applicants' claims and will be described in the following detailed description of the invention and the accompanying drawings.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE INVENTION

Preferred embodiments of an arcade roping game and practice device according to the present invention will now be described in detail with reference to FIGS. 1 to 15 of the accompanying drawings.

Figure 1:
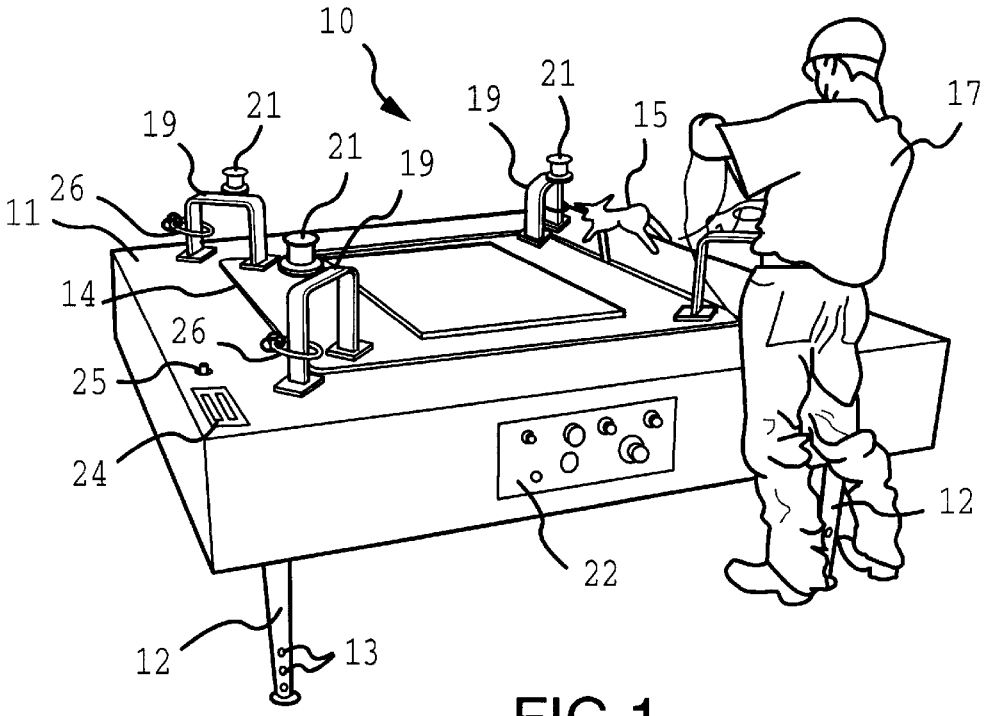
FIG. 1 is a perspective view of an assembled arcade table roping game and practice device according to the present invention with a player positioned at one of the four corners of the table in the process of roping the back legs of a steer that moves around the table.
Figure 2:
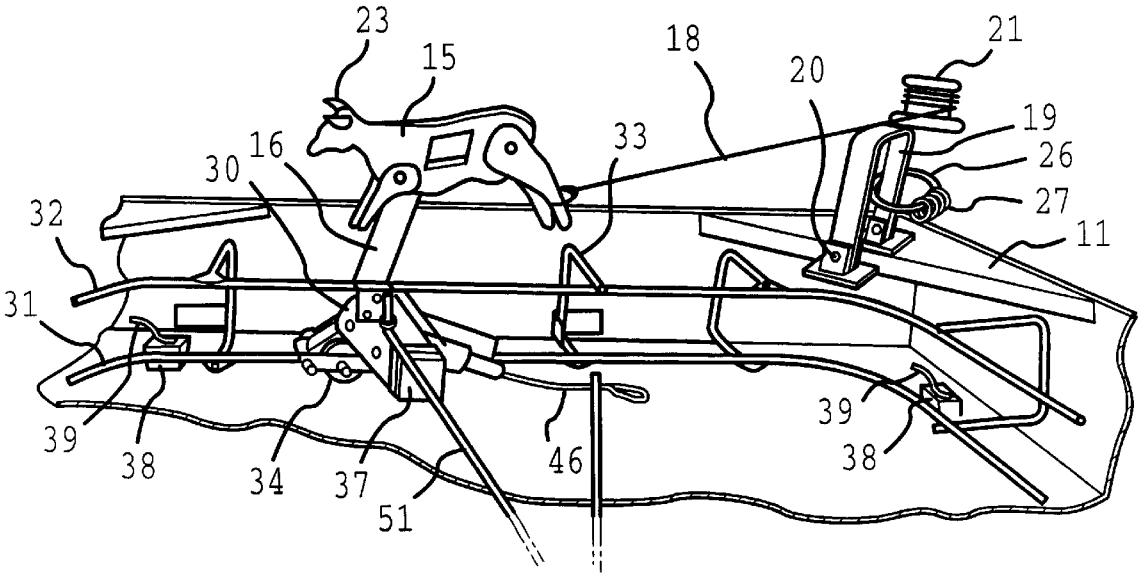
FIG. 2 is a perspective view of a portion of the game table with the top cover removed to show a track assembly and wheeled trolley for guiding the steer around the table.

As shown in FIGS. 1 and 2, a roping game and practice device 10 according to a preferred embodiment of the present invention includes a generally square-shaped table 11 supported by a plurality of legs 12 at each of the four corners of the table. The legs 12 are adjustable in length to adjust a height of the table 11 for different sized players. For example, the legs 12 can have a telescoping member and a plurality of pin holes 13 to provide a telescoping adjustment of the legs 12 for adjusting the height of the table 11.

A slot 14 is formed through a top surface of the table 11 and extends around the table in a generally square-shaped path with slightly rounded corners. A roping steer 15 or other suitable object to be roped is supported by a rigid member 16 (e.g., a flat iron) which extends through the slot 14. The rigid member 16 is driven around a track within the table 11 by a trolley arrangement which will be further described below. The steer 15 is thereby propelled around the table 11 in a generally rectangular path defined by the slot 14. The game table 11 should be large enough that a player 17 can get his or her rope 18 ready before the steer 15 comes around the table each time.

An arch structure 19 is provided at each corner of the table 11. The arch structures 19 each have a generally inverted U-shape and are positioned over the slot 14 at each corner. The steer 15 passes beneath and through the arch structures 19 as the steer 15 travels around the table 11. The arch structures 19 are mounted to the table 11 in a manner whereby they can be folded about pivot points 20 to lay over the top surface of the table 11 to facilitate transporting and storing the game table 11.

A dally horn 21 is mounted on top of each of the arch structures 19. The dally horns 21 are each constructed in the general shape of a saddle horn. A switch assembly is provided in each of the dally horns 21 to detect when a player's rope 18 is wrapped around the dally horn 21 and pulled tight. The details of the dally horn construction will be explained later with reference to FIG. 9 of the drawings.

The game table 11 has a control panel 22 on a side surface thereof which includes, for example, a variable speed control to set the traveling speed of the steer 15 and to stop the steer 15 if necessary (e.g., to take a loop off the steer's horns 23), a coin counter to accept money or tokens for operation of the game, a key operated switch to bypass the coin counter, a push button switch for simulating coins being fed to the machine when the key operated switch is in a bypass position, a lamp for indicating when power is provided to the trolley for moving the steer 15, a safety resetable circuit breaker in case of electrical overload, a volume control for sound, and a push button start switch to start the steer moving when a roper in the number 1 corner is ready. The control panel 22 can also be equipped with a skill level switch that sets the operating parameters of the game (e.g., hopping action of the steer) according to the skill level of the players.

A display device 24 is provided at each corner of the game table 11 to display a player's time for each roping attempt and the number of times the steer 15 has passed by the player. The display device 24 displays a running total of the player's time as the steer travels around the table two or more times. A reset button 25 is also provided at each corner so that each player can manually clear their respective display device 24 to separately time each roping attempt. Alternatively, the display device 24 can be made to display an accumulated time for two or more roping attempts as well as a separate time for each roping attempt. The display device 24 can also be located on other parts of the table 11 or can be connected to a remote control box positioned away from the table.

A manual scoring system 26 is provided at each corner to keep track of a player's penalties. The manual scoring system 26 includes a ring-shaped member secured to each of the arch structures 19, and a plurality of beads or washers 27 slidably mounted on each ring-shaped member. The beads or washers 27 can be slid from one side of the ring-shaped member to the other when a player receives a penalty for roping the wrong part of the steer 15. For example, if only one rear leg of the steer 15 is roped, as shown in FIG. 2, the player will get a penalty. At the end of the game, a preset penalty (e.g., 1 or 2 seconds) is added for each bead or washer 27 moved to the other side of the ring-shaped member. The ring-shaped member is preferably inclined upwardly away from the arch structure 19 so as to keep the beads or washers 27 from sliding from one side of the member to the other side inadvertently. The ring-shaped member also provides a convenient place to hang a rope when a player is not using a particular corner of the game table 11.

In a basic operation of the game 10, the steer 15 moves around the table 11 along the path defined by the slot 14. As the steer 15 turns a corner and passes under one of the arch structures 19, a player's timer starts, the player throws a loop around the rear legs of the steer 15, the player dallies the rope 18 around the dally horn 21, and the player's timer is automatically stopped by the switch assembly in the dally horn 21. The steer 15 then continues to move away from the player 17, the back legs of the steer 15 pivot rearward as the rope 18 is pulled tighter, and the rope 18 is easily slipped off of the back legs, thereby allowing the steer 15 to continue moving around the table 11 to the next corner. The player's time remains displayed by the display device 24 until the display device 24 is reset by the player pushing the reset button 25.

The game 10 is also preferably equipped with a sound system that makes a first sound when a player's timer is started, a second sound when a player successfully ropes and dallies the steer 15, and a third sound when a player fails to rope and dally the steer 15. To make the game entertaining and more realistic, the first sound (when the timer starts) is preferably a beep, the second sound (successful roping) is a pleasant tune, such as a few notes of the song "Shave and a Haircut, Six Bits," and the third sound (unsuccessful roping) is an unpleasant tune, such as the first notes of the tune "Too Bad, So Sad."

As shown in FIG. 2, the steer 15 is supported by a wheeled trolley 30 through the rigid member 16 that extends through the slot 14 in the table 11. The wheeled trolley 30 is guided around the table 11 by a closed-loop track assembly 31, 32. The track assembly includes a lower track 31 and an upper track 32. The lower and upper tracks 31, 32 are each supported by a series of rigid support members 33 that are fixed in place within the enclosure of the game table 11. The lower track 31 is supported in such a way that an upper surface and sides of the lower track 31 are free of protrusions. Similarly, the upper track 32 is supported in such a way that a lower surface and sides of the upper track 32 are free of protrusions.

The wheeled trolley 30 includes a pair of lower wheels 34, 35 that engage the lower track 31 and an upper wheel 36 that engages the upper track 32. An electric motor 37 (e.g., 115 V motor) is mounted on an inner side of the trolley 30 and drivingly connected to a rear one 35 of the lower wheels of the trolley 30. A direct drive connection is preferred between the electric motor 37 and the rear lower wheel 35 for simplicity and reliability.

The trolley 30 has a construction wherein the upper wheel 36 is biased away from the front lower wheel 34 to bias both the upper and lower wheels 34, 35, 36 into engagement with the upper and lower tracks 31, 32, respectively. Further details of the trolley 30 will be explained below with reference to FIGS. 5 and 6.

Also shown in FIG. 2 are switches 38 positioned at each corner of the game table 11. The switches 38 each include a contact portion 39 that extends upwardly into the path of a member that moves with the trolley 30. For example, a drive shaft 40 extending from the electric motor 37 through the rear lower wheel 35 can be made to extend outwardly from the trolley 30 to engage the contact portion 39 of the switches 38 when the trolley 30 traverses each corner of the game table 11. The switches 38 are used to start the timer for each player as the steer 15 moves through the arch structure 19 at each corner of the game table 11.

Figure 3:
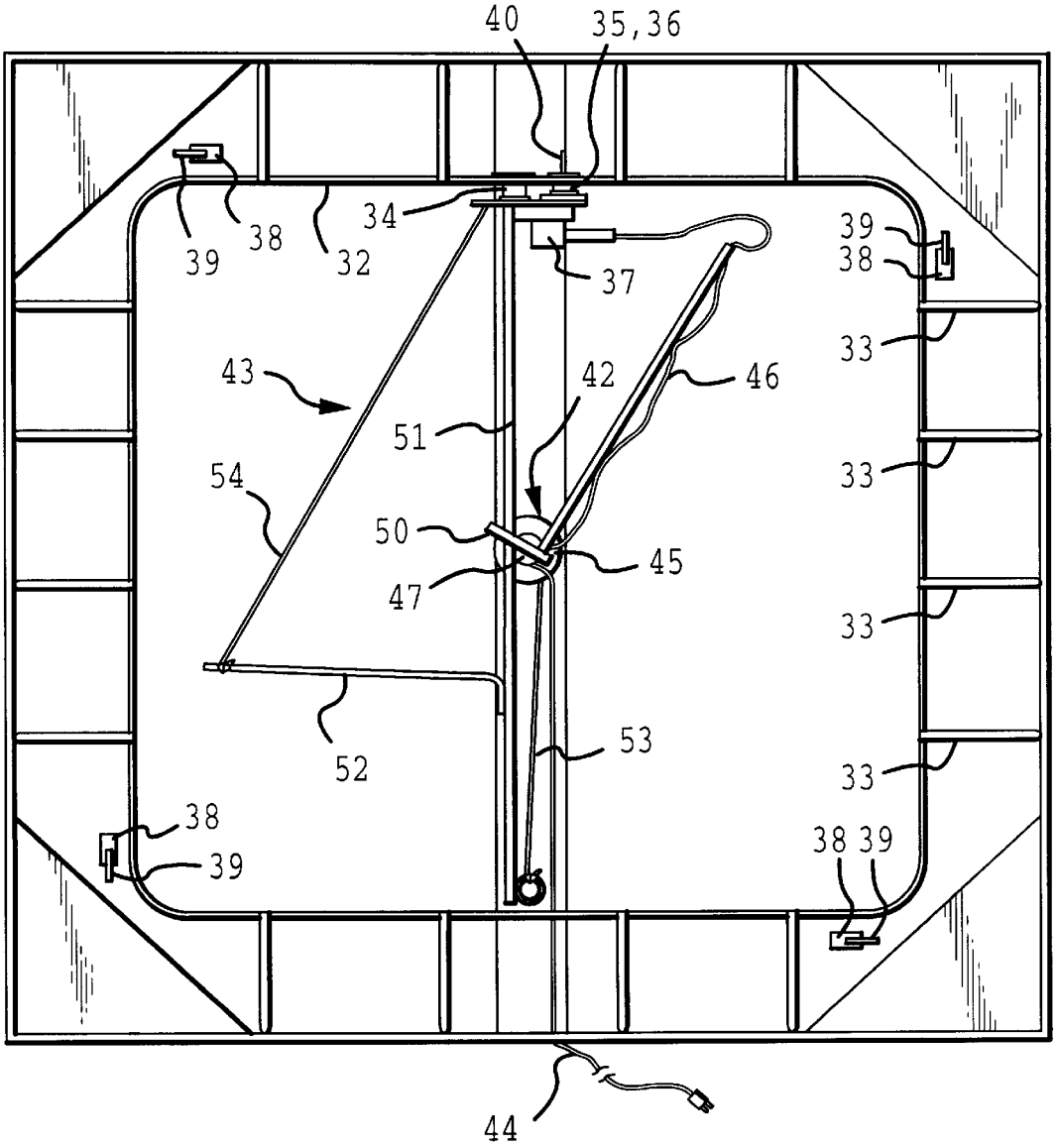
FIG. 3 is a plan view of the game table with the top cover removed and the trolley positioned at a midpoint along one side of the table.
Figure 4:
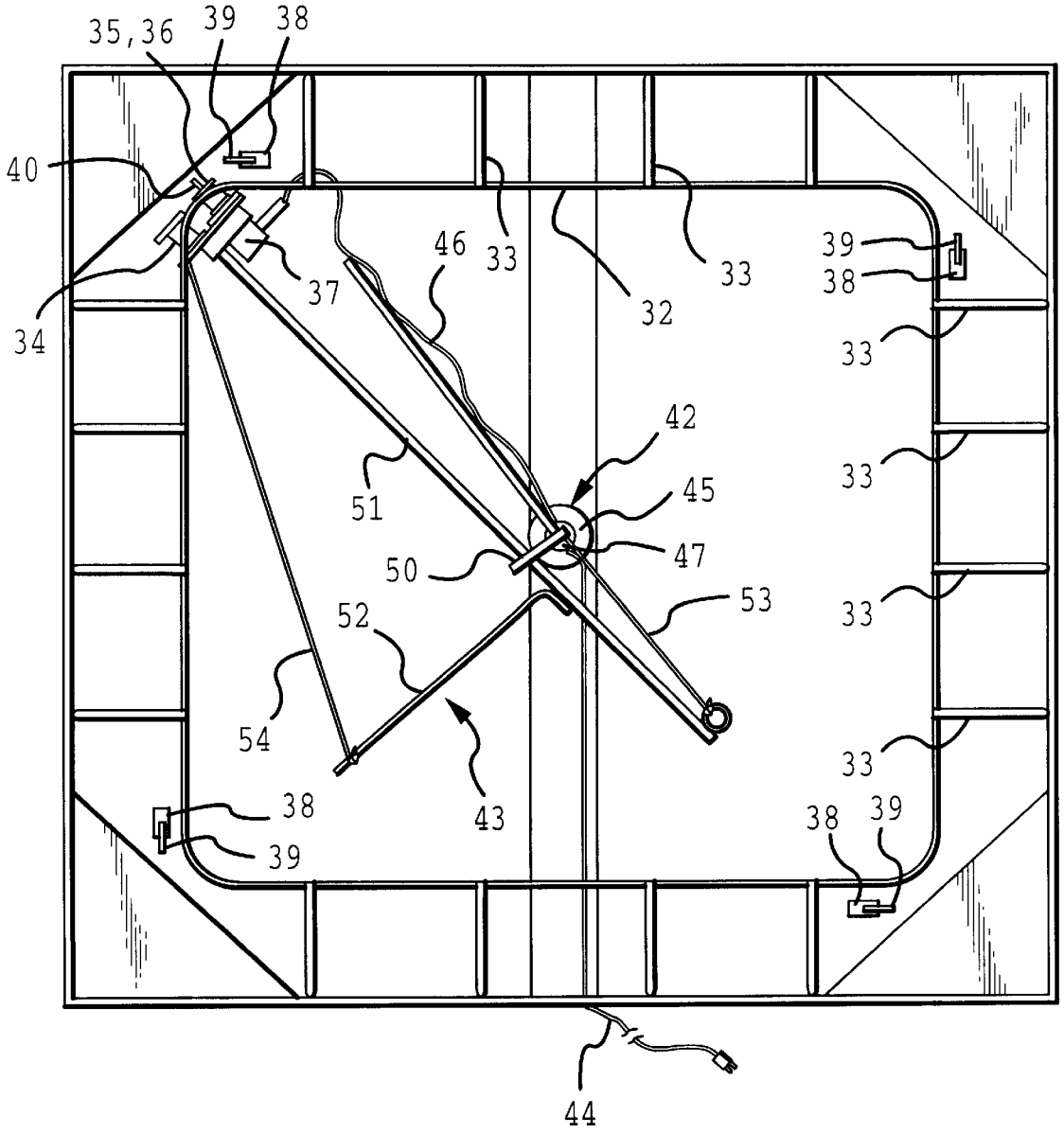
FIG. 4 is a plan view of the game table with the top cover removed and the trolley navigating a corner of the table.

A slip ring electric distributor assembly 42 and a guiding arrangement 43 for guiding the trolley 30 around the track 31, 32 will now be described by reference to FIGS. 2 to 4 of the drawings.

The slip ring electric distributor assembly 42 is positioned in an approximate center of the track 31, 32 to provide power from a stationary power source 44 (e.g., a power cord for connecting to a wall outlet) to the moving trolley 30. The slip ring assembly 42 has a box housing structure 45 which houses a stationary electrical input and a rotating electrical output. The slip ring assembly 42 keeps the power cord 46 to the electric motor 37 from twisting and the trolley 30 running smoothly.

The stationary input of the slip ring assembly 42 is connected to the stationary power source 44 through an electrical wire harness or the like. The stationary input has a plurality of conductive brushes or the like placed in sliding electrical contact with conductive elements on a rotating output shaft 47. The power cord 46 extends from the rotating output shaft 47 to the drive motor 37 on the trolley 30 for supplying electrical power to the trolley 30.

The guiding arrangement 43 for guiding the wheeled trolley 30 around the closed-loop track 31, 32 includes a guide assembly 50 mounted to the rotating output shaft 47 of the slip ring assembly 42. The guide assembly 50 can be in the form of a rectangular assembly of PVC pipe, for example. A support member 51, such as an elongate metal rod, extends through the guide assembly 50 and is slidably supported by the guide assembly 50. The support member 51 is pivotally connected at one end to an inner side of the trolley 30 (see FIG. 2). A first resilient member 53, such as a length of surgical rubber, extends between the guide assembly 50 and the support member 51 for biasing the support member 51 toward the trolley 30. An offset member 52, such as an elongate metal rod, is fixed to the support member 51 and extends away from a longitudinal axis of the support member 51. A second resilient member 54, such as a length of surgical rubber, extends from a free end of the offset member 52 to a point on the trolley 30 forward of the pivotal connection of the support member 51 to the trolley 30.

The guiding arrangement 43 facilitates movement of the trolley 30 around the track 31, 32. The guiding arrangement 43 is particularly useful to help the trolley 30 traverse the rather sharp corners of the track 31, 32. The guiding arrangement 43 facilitates cornering of the trolley 30 by use of the resilient member 54 connected to the front of the trolley 30, which effectively pulls the front of the trolley 30 around the corners of the track 31, 32. Also, as seen in FIGS. 3 and 4, the front lower wheel 34 of the trolley 30 is wider than the other wheels 35, 36 of the trolley to permit the front of the trolley 30 to traverse the corners of the track 31, 32 with less resistance.

Figure 6:
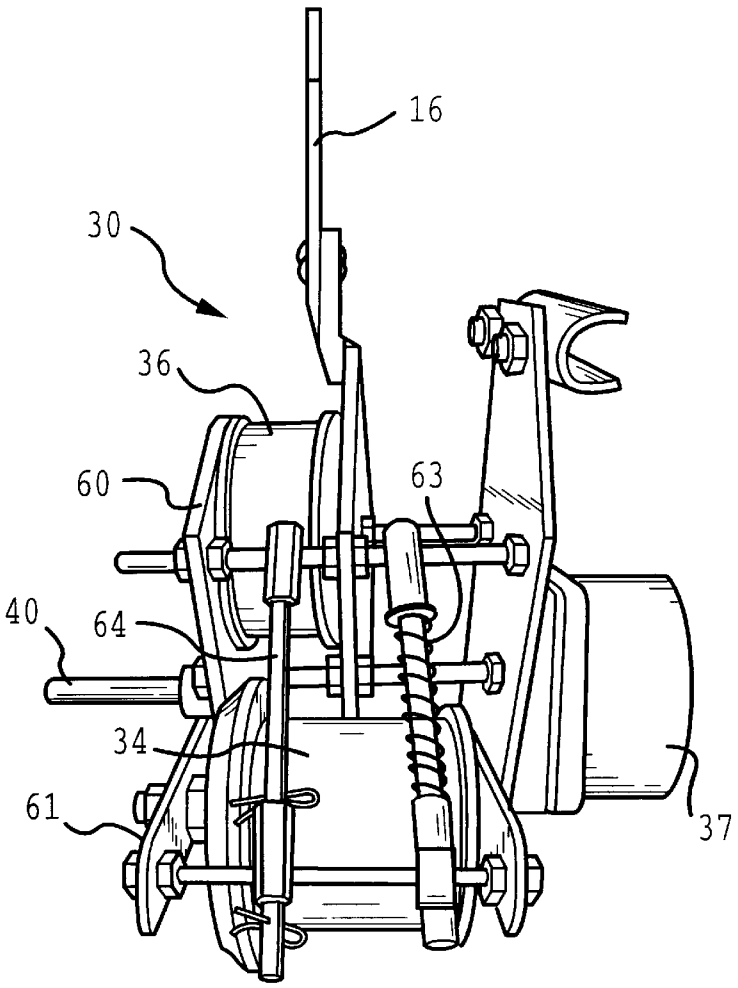
FIG. 6 is a perspective front view of the three-wheeled trolley shown in FIG. 5.
Figure 5:
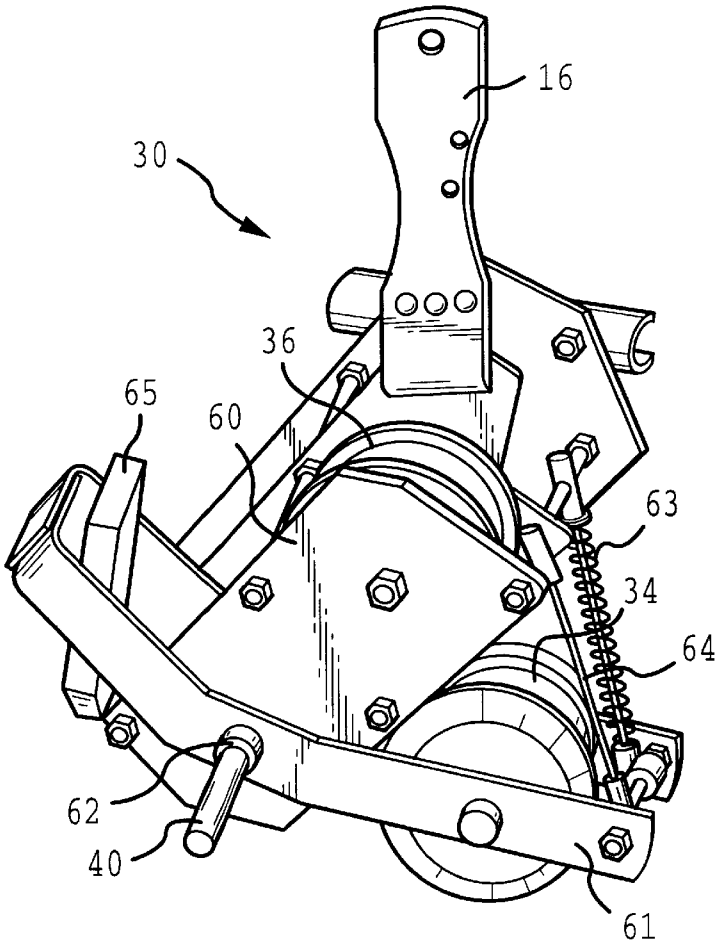
FIG. 5 is a perspective side view of the three-wheeled trolley for supporting the steer.

As shown in FIGS. 5 and 6, the trolley 30 includes a main frame 60 for supporting the rear lower wheel 35, the upper wheel 36, the electric drive motor 37, and the rigid member 16 supporting the steer 15. A second frame 61 for supporting the front lower wheel 34 is pivotally connected to the main frame 60 about the pivot point 62. A spring biasing member 63 and movement limiting linkage 64 extend between the frames 60, 61 at a front portion thereof to bias the frames 60, 61 away from each other so that the wheels 34, 35, 36 of the trolley 30 are biased into engagement with the upper and lower tracks 31, 32, respectively. This construction of the trolley 30 causes the rear lower wheel 35 (the drive wheel) to be lifted slightly from the track 31 when the rear legs of the steer 15 are roped during normal operation of the game, thereby temporarily keeping the trolley 30 from being driven forward while the player dallies the rope.

The trolley 30 also includes a rear fulcrum member 65 supported behind the rear lower wheel 35. A bottom end of the fulcrum member 65 is located near the lower track 31 and provides a fulcrum for causing the rear lower wheel 35 (the drive wheel) to be lifted slightly from the track 31 when the horns 23 of the steer 15 are roped during normal operation of the game. Thus, when the rear legs of the steer 15 are roped, the trolley 30 pivots slightly about the front lower wheel 34 to cause the rear lower wheel 35 to be lifted from the track 31, and when the horns 23 of the steer 15 are roped, the trolley 30 pivots about the rear fulcrum member 65 to cause the rear lower wheel 35 to be lifted from the track 31.

As mentioned above, the front lower wheel 34 of the trolley 30 is wider than the rear lower wheel 35 and the upper wheel 36 to facilitate movement of the trolley 30 around the corners of the track 31, 32 while maintaining stability of the trolley 30 on the straight sections of the track 31, 32. The wheels 34, 35, 36 are made, for example, of polyvinyl, metal, or other suitable high-strength material. The wheels 34, 35, 36 also have integral side ridges to keep the wheels correctly positioned on the upper and lower tracks 31, 32. Also shown in FIG. 6 is the drive shaft 40 of the electric motor 37, which extends outwardly from the trolley 30 to engage the switches 38 placed at the corners of the game table 11 to start the timers as the steer 15 passes under the arch structures 19.

Figure 7:
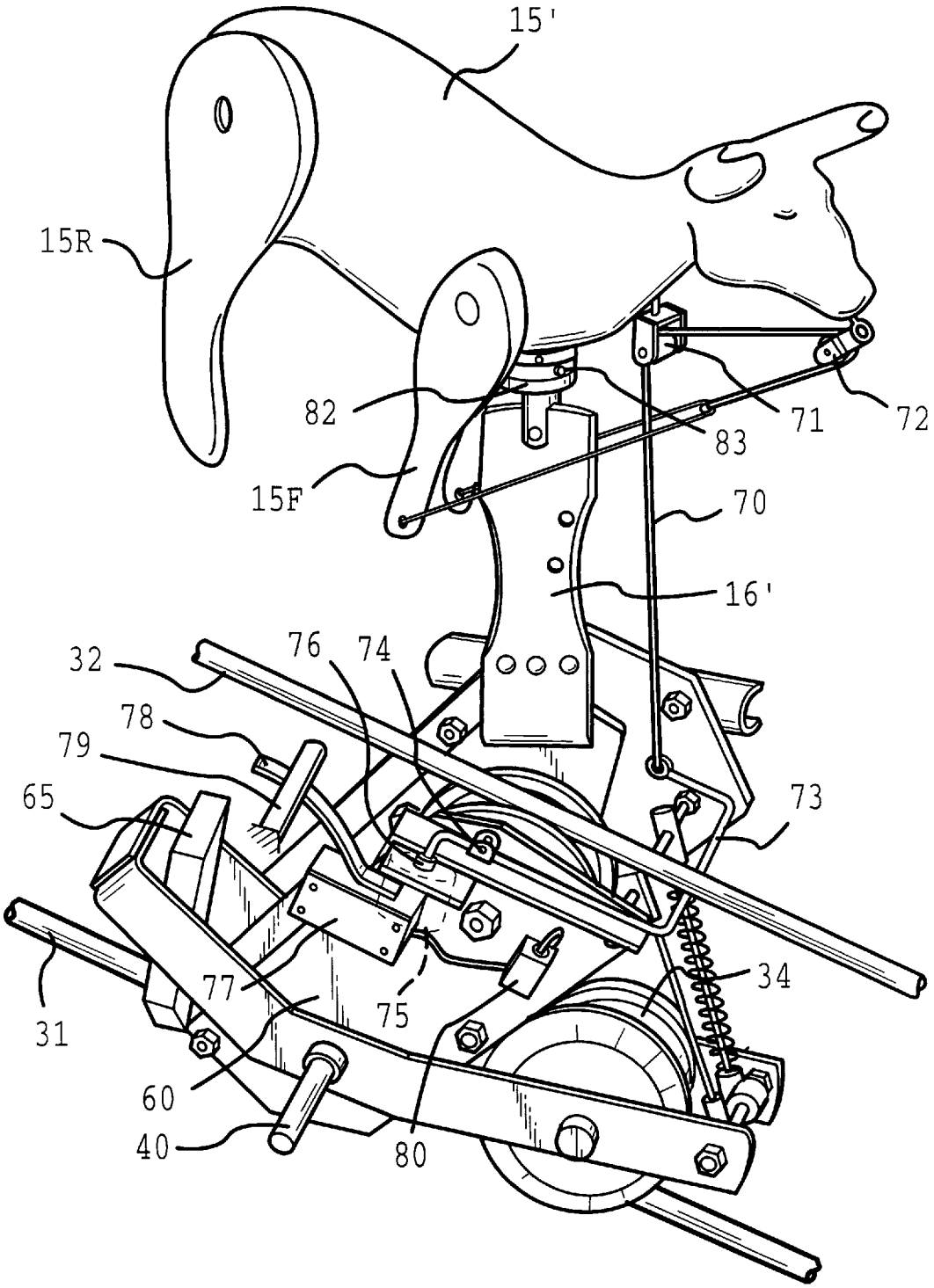
FIG. 7 is a perspective view of a trolley and steer assembly according to a second embodiment of the present invention, which includes an arrangement for making the steer move up and down in a hopping manner.

Referring to FIG. 7, an alternative embodiment of the trolley and steer will be described for providing the steer with a "hopping" action as it travels around the game table. Those elements shown in FIG. 7 that are similar to the elements in the first embodiment described above will be designated by the same reference numerals.

As shown in FIG. 7, the steer 15' has a tension element assembly 70, such as a rope, cord, cable, wire or the like, connected to each of the front legs 15F of the steer and extending over a pulley arrangement 71, 72 connected to the neck and nose of the steer 15', respectively. The tension element assembly 70 is connected at its other end to an end of a lever 73, which is pivotally mounted about a pivot point 74 to the main frame 60 of the trolley 30. A pull-type electric solenoid actuator 75 is also mounted to the main frame 60 of the trolley 30 and has a movable actuator portion 76 engageable with the other end of the lever 73. By using the lever 73, the length of the stroke of the steer movement can be increased over the length of the stroke of the solenoid actuator 75.

A hop switch 77 is mounted on the trolley 30 and has a switch lever 78 extending therefrom into the path of stationary switch activators 79, which are spaced along the trolley track 31, 32 at suitable locations. For example, a switch activator 79 can be positioned on an upper portion of each of the support members 33 to cause the switch 77 to be activated four times on each side of the table 11. An on/off switch 80 is also provided on the trolley 30 to disable the solenoid actuator 75 when hopping action is not desired (e.g., for novice players).

The steer 15' is pivotally mounted to the rigid member 16' extending from the trolley 30 so as to permit movement of the steer 15' about a generally transverse axis relative to the direction of movement of the steer 15'. A preferred mounting arrangement includes a stop washer assembly 82 with set screws 83 on a front and back side to adjust the extent of pivotal movement of the steer 15'. With this arrangement, the steer 15' can be adjusted to have its rear legs 15R close to the surface of the table 11 until the steer 15' is made to hop. This simulates a real life roping event where the roper must time his throw to pass under the hooves of the steer while the steer is hopping.

When the solenoid actuator 75 is energized by engagement of the switch lever 78 with a switching element 79, it causes the lever 73 to pivot and pull the lower end of the tension element assembly 70 downwardly. Since the tension element assembly 70 is connected to the lower ends of the front legs 15F of the steer 15' through the pulley arrangement 71, 72, the front legs 15F of the steer 15' are pivoted forwardly. Once the front legs 15F are pivoted forwardly, the tension in the tension element assembly 70 then causes the front of the steer 15' to pivot downwardly about the pivot connection 82, thereby making the rear legs 15R of the steer 15' move upwardly. This simulates a real life hopping action of a steer that has been roped by a header, whereby the steer appears to dig-in its front legs and then lower its head and start hopping with its back legs. The front legs 15F are biased by a spring arrangement to pivot back to their normal position after the solenoid 75 is deenergized, and the steer 15' also pivots back to its normal position due to the pivot connection 82 being located in front of a center of gravity of the steer 15'.

The action of the steer 15' in this embodiment makes it quite enjoyable and challenging to rope. The front legs 15F periodically come back into the space where the loop of the rope normally goes through while roping the back legs 15R. The front legs 15F are then pulled forward out of the way and the back feet of the steer 15' come up off the roping surface. In real life roping, this is by far the best time to rope for heeling.

Figure 8:
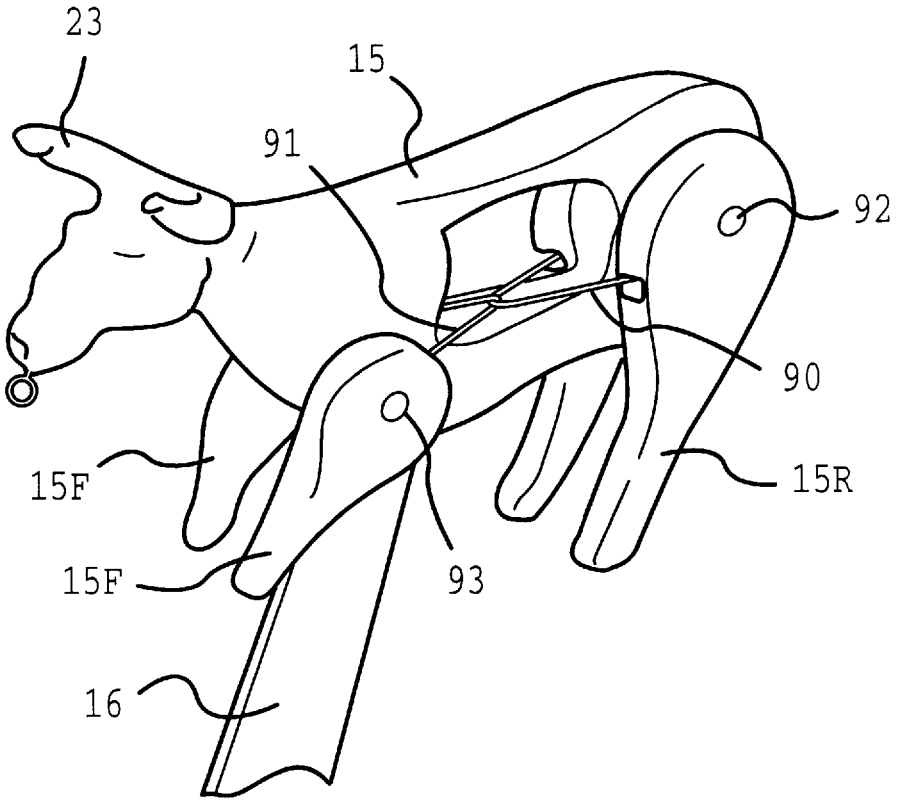
FIG. 8 is a perspective view of the steer, with a cut-away portion showing rubber cords for making the rear legs of the steer spring back to a forward position after a player's rope is removed, and showing rubber cords for biasing the front legs of the steer to a rearward position.

As shown in FIG. 8, the steer 15 includes spring members 90, 91 connected to each of the front and rear legs 15F, 15R of the steer. The spring members 90, 91 are preferably in the form of a length of surgical rubber or the like for smooth operation. With this arrangement, the rear legs 15R of the steer 15 are biased forwardly about their pivot points 92, and the front legs 15F are biased rearwardly about their pivot points 93. A first piece of surgical rubber 90 can be connected to the rear legs 15R and looped through a second piece of surgical rubber 91 connected to the front legs 15F. Alternatively, the surgical rubber pieces 90, 91 for the front and rear legs can be kept separate from each other and looped around a smooth surface within the body cavity of the steer 15. This latter arrangement may have some advantages in increasing the longevity of the rubber pieces 90, 91 since the rubber pieces 90, 91 are not subjected to any tight bends or stress points.

Figure 9:
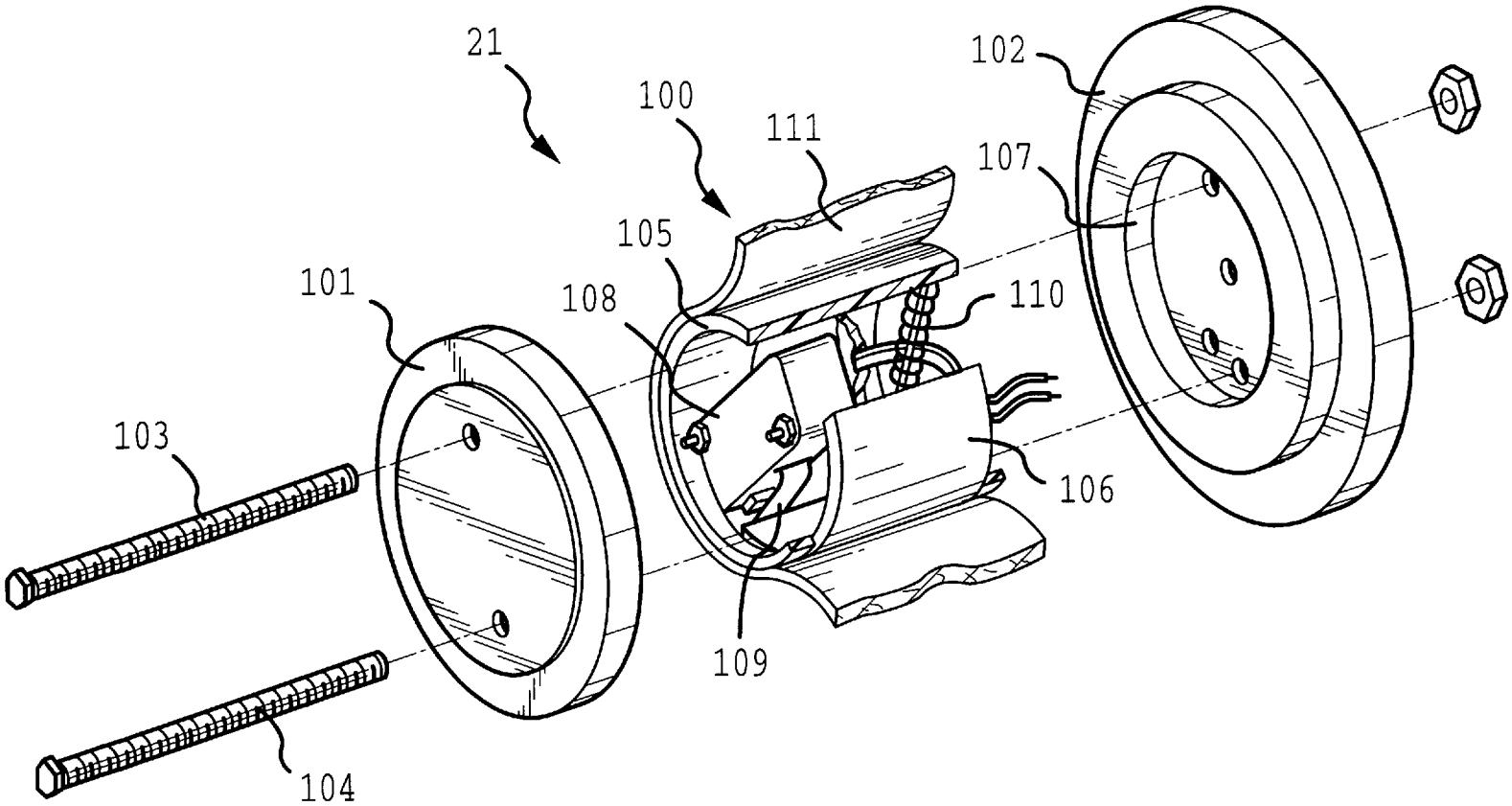
FIG. 9 is an exploded perspective view of a dally horn and switch assembly for automatically stopping a timer of the roping game when a player's rope is wrapped around the dally horn.

Referring to FIG. 9, further details of the dally horn 21 and the switch assembly therein will now be described. The dally horn 21, which generally resembles a saddle horn in appearance, includes a cylindrical portion 100 and upper and lower flanges 101, 102 placed over the ends of the cylindrical portion 100. A pair of screw fasteners 103, 104 or the like are used to hold the components of the dally horn 21 together in an assembled unit.

A core 105 of the cylindrical portion 100 can be made of a short section of PVC pipe, for example. A rectangular segment 106 is cut out of the wall of the pipe core 105 and remounted to the pipe by a hinge. The hinge allows the rectangular segment 106 to pivot inwardly when a pressure is placed on an outer surface of the cylindrical portion 100. The pipe core 105 is preferably fitted into a groove 107 in both the top and bottom flanges 101, 102 of the dally horn 21 so that the movable segment 106 extends over the entire exposed length of the cylindrical portion 100 between the top and bottom flanges 101, 102, making it impossible for the rope when it is dallied to miss the movable segment 106.

A switch 108 with a contact portion 109 is mounted within the core 105 of the cylindrical portion 100 in a manner wherein it is actuated by inward movement of the pivotal segment 106. A spring 110 is provided to bias the pivotal segment 106 away from the contact portion 109 of the switch 108. As explained above, the switch 108 provides a means for automatically stopping a player's timer when the player's rope is wrapped around the dally horn 21. The construction of the dally horn switches are also effective to prevent false triggering by a roper simply touching the dally horn 21 with his or her fingers to stop the timer.

A leather covering 111 is placed over the cylindrical portion 100, and the upper and lower flanges 101, 102 can be made of leather to simulate a conventional saddle horn. The leather covering 111 over the cylindrical portion 100 is flexible enough that the switch 108 will be actuated whenever a proper dally is made by a player wrapping his or her rope around the dally horn 21. The dally horn 21 is preferably oriented such that the pivotal segment 106 of the cylindrical portion 100 is on a side of the dally horn 21 facing away from the steer 15 being roped so that the force of the moving steer 15 will help actuate the switch 108 when the player's rope is dallied.

As mentioned above, in the team roping event of a rodeo, steer stopping and single steer two person team roping, one player (the header) ropes the steer's horns, dallies a rope around the saddle horn, and causes his horse to tighten the rope, slow, and turn, thereby pulling the steer across the arena and making the rear legs easier for the other team member to rope. The other team member (the heeler) wants the steer to hop with both back legs going up and down together.

The present invention provides a unique track design that reproduces closely the same action as in a rodeo arena of the steer's rear legs. As the steer 15 turns one of the corners, the steer 15 swings out making realistic roping of the rear legs 15R with up and down hops.

The present invention removes human error in timing each player's roping attempts and thus makes sure that prizes are awarded to the roper with the fastest time. The automatic dally timer shut off takes human error out of the game because no one but the roper is stopping the clock. The present invention also allows more ropers to play at one time and to dally the rope on a device similar to a saddle horn. In team roping, the player's rope is dallied around the saddle horn after the catch. In the present invention, the player's rope is also wrapped around a horn 21 after catching the steer 15.

The present invention provides an arcade table or floor roping game machine that simulates the heeling part of the team roping event. However, for practice, the horns 23 of the moving steer 15 may also be roped.

At the rodeo event of team roping the steer goes out of a chute into the rodeo area. With the present invention, the steer goes through a chute arch 19 making the game more realistic and unique for practicing both heeling (i.e., roping the back legs) and heading (i.e., roping the horns of the steer).

Up to four ropers can play the game according to the preferred embodiment, one at each of the four corners. The chute arches 19 at each corner keep the ropers from "cross firing," which is a rule in team roping events that the loop cannot leave the roper's hand before the steer's front and rear legs are turned to follow the heading horse. When heeling with the present invention (i.e., roping the steer's rear legs), the heel rope comes off the rear legs of the steer without stopping the steer. When heading with the present invention (i.e., roping the steer's horns), the speed control of the electric motor 37 on the trolley 30 can be turned down. That also turns the power down to the steer 15 so that when a player ropes the horns 23 and stops the steer, the steer will stay stopped while the player takes the rope off the horns. Then with a little push, the steer can be made to go again.

The arch structures 19 of the present invention prevent participants from roping the steer before it goes through the arch. At each corner is an arch switch 38, lap counter/counters, and a computer controlled digital electronic timer.

Each arch structure 19 supports a dally horn 21, which is similar to a real leather covered saddle horn. Inside the dally horn 21 is a special pressure switch that is activated by tension of the player's rope.

As the game starts, the steer goes through chute number one which activates a start switch that is connected to a computer. The computer makes a beep sound through an audio amplified speaker and starts chute number one's digital timer. The digital timer starts and continues to run until the participant ropes the rear legs or horns of the steer and wraps the rope 18 around the dally horn 21. The tension of the rope 18 activates the switch 108 in the horn 21, which is connected to the computer that stops the digital timer for the first roper. The computer then plays a pleasant musical tune to reward the participant for roping the steer's rear legs. Should the first roper fail to rope or miss the rear legs of the steer, he gets a penalty. The computer controller timer adds penalty seconds to the first roper's timer. The computer then stops the digital timer and a plays an unpleasant tune.

The steer continues on to the next roper at arch number two, and the roping event is repeated for ropers at each of corner numbers 2, 3 and 4. As the steer makes a lap around the track, it can be roped by up to four ropers.

The steer's horns can also be roped, and the steer's rear legs are adjustable for height, thus making roping the rear legs easier or more difficult. As the steer's rear legs are roped, the rope tension will cause the legs to spring backwards, which allows the rope to slide off the rear legs. The steer does not have to stop to have the rope taken off. This makes the present invention a fast-moving exciting game that is not only entertaining but can bring out the competitive spirit in all ages of ropers and non-ropers who are willing to take the challenge to beat their peers for the best roping time.

There is also an educational aspect to the present invention because it teaches timing and reflex of quick and accurate action of the dally movement, which is good training for the safety of keeping thumbs and fingers out of the dally. The game provides each roper his own timer. The game has lap counters so participants can see at a glance the number of laps the steer has gone around. The computer and timers keep track of each individual participant's total time for 1 to 200+ steers (or laps).

The length of time for the steer to go around the track is approximately eight seconds plus or minus two. What adds to the excitement of the game is getting the rope coiled just right and the loop the right size and shape. The roper then gets in the best position to rope the rear legs of the steer. The timers can be reset if so desired by the roper to see what his or her individual best roping time can be on one steer or more.

The game can be operated by a key or by coins or other tokens. The game can be provided with a computer that counts the coins or tokens and gives a predetermined number of laps for each.

The game, when not in use as a coin or key turn operation, can be run from a cable remote. The operator of the remote control takes entries and keeps track of the times and can clear a single player's clock or all of the players' clocks at once and run and stop the steer.

The height of the machine can be adjusted for different size ropers. The machine fits through doors when it is turned on its side. The chute arches 19 are designed to fold down to facilitate transporting and storing the game table 11.

The electrical control system of a preferred embodiment of the present invention will now be explained by reference to FIGS. 10 to 15 of the drawings.

Figure 10:
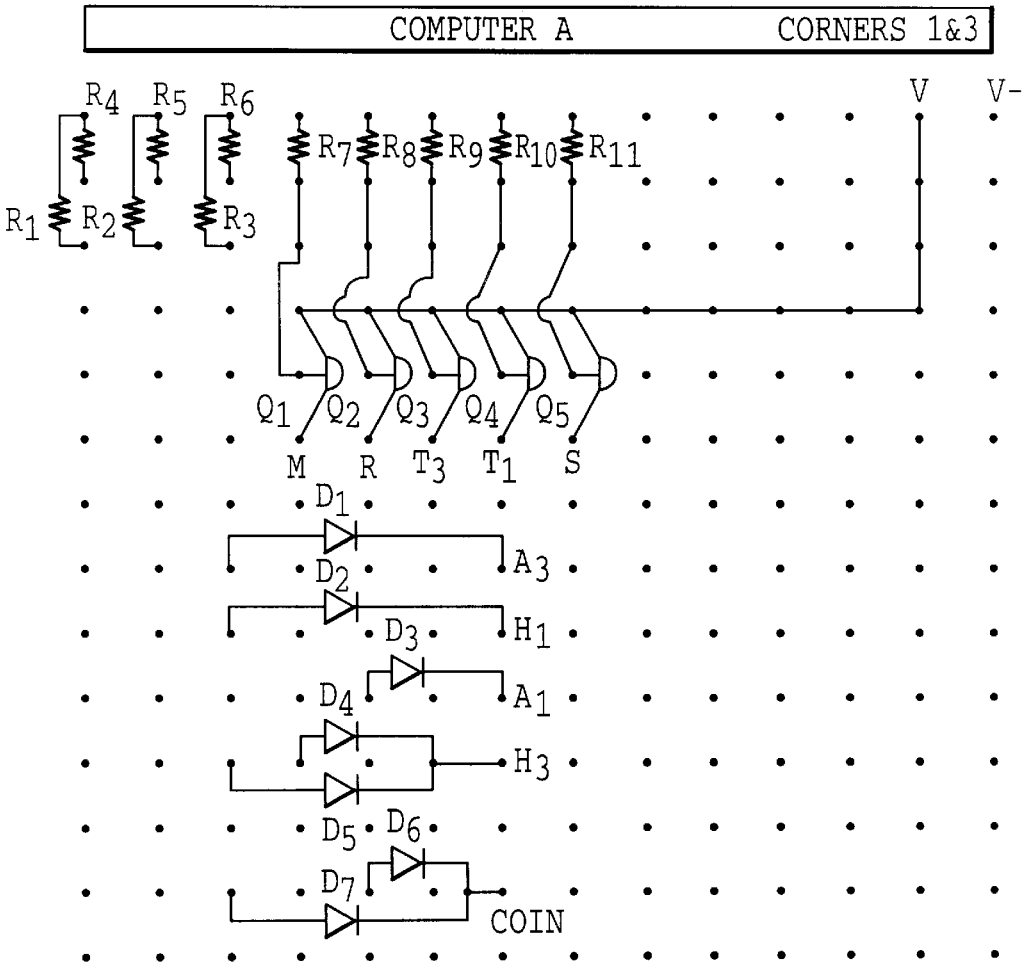
FIGS. 10 to 15 are schematic circuit diagrams showing electric circuits suitable for controlling the operation of the roping game according to the present invention.

FIG. 10 shows a computer circuit A of the roping game which counts coins, gives the proper amount of roping time or laps, stops the electric trolley motor when the proper time or laps are given for the amount of coins put in, produces a sound output for an audio amplifier, and controls the timers in corners 1 and 3 of the game table.

The computer circuit A has inputs $A_3$, $H_1$, $A_1$, $H_3$, V−, and V+, and outputs M, R, $T_3$, $T_1$, and S. Input $A_3$ is an input from the arch switch at the number 3 corner, input $H_1$ is an input from the horn switch at the number 1 corner, input $A_1$ is an input from the arch switch at the number 1 corner, $H_3$ is an input from the horn switch at the number 3 corner, input V− is a common ground for the circuit, and input V+ is connected to a 10 V DC power source. Output M is a motor control for the trolley, output R is a reset, output $T_3$ controls the timer at corner number 3, output $T_1$, controls the timer at corner number 1, and output S is a sound output to the audio amplifier. The computer circuit A also includes IN4001 diodes $D_1$, to $D_7$, 10K ⅛ watt resistors $R_1$ to $R_3$, 100K ⅛ watt resistors $R_4$ to $R_{11}$, and 2N2222 NPN switch transistors $Q_1$, to $Q_5$.

Figure 11:
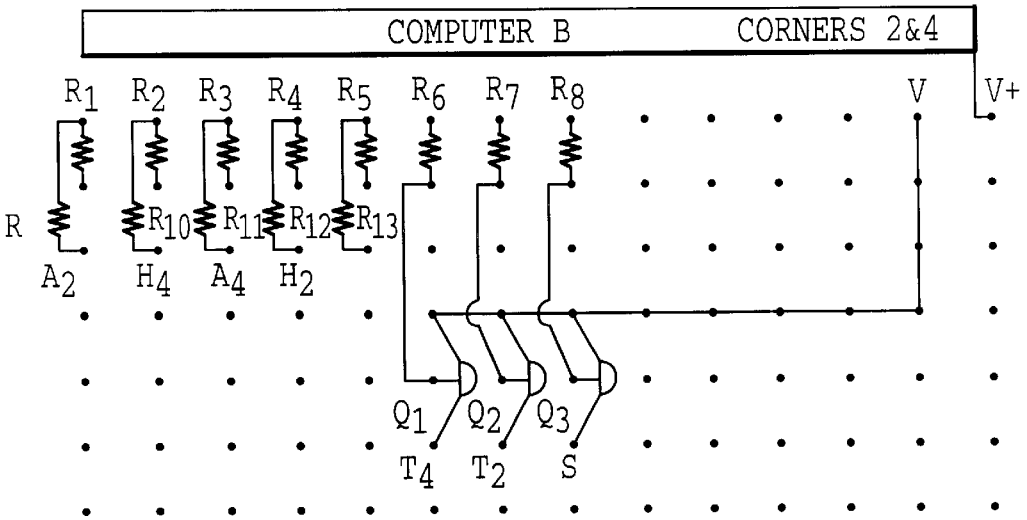

FIG. 11 shows a computer circuit B of the roping game which controls the timers in corners 2 and 4 and produces sound output for the audio amplifier. The computer circuit B has inputs $A_2$, $A_4$, $H_2$, $H_4$, and outputs $T_4$, $T_2$, and S. Input $A_2$ is an input from the arch switch at corner number 2, input $A_4$ is an input from the arch switch at corner number 4, input $H_2$ is an input from the horn switch at corner number 2, and input H4 is an input from the horn switch at corner number 4. Output $T_4$ controls the timer at corner number 4, output $T_2$ controls the timer at corner number 2, and output S is a sound output to the audio amplifier. The computer circuit B also includes 100K ⅛ watt resistors $R_1$. to $R_8$, 10K ⅛ watt resistors $R_9$ to $R_{13}$, and 2N2222 NPN switch transistors $Q_1$ to $Q_3$.

Figure 12:
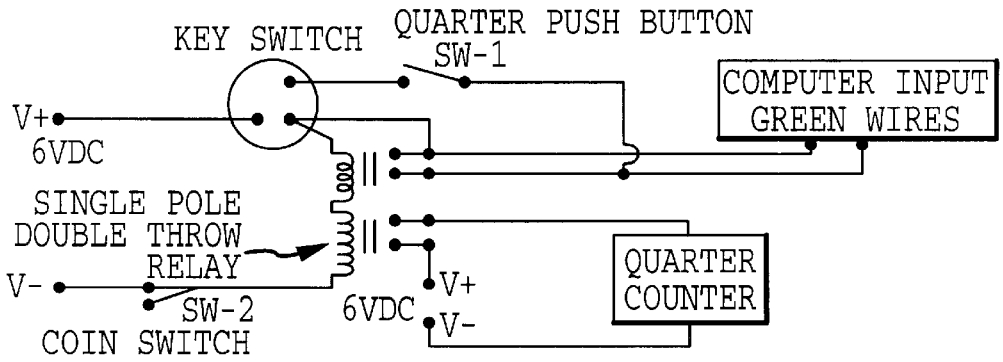
Figure 13:
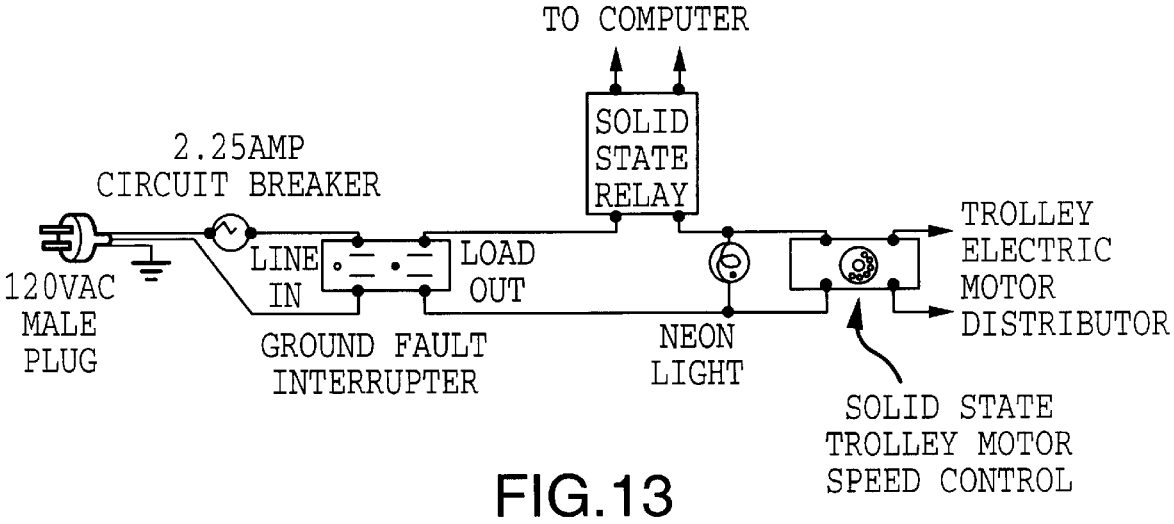
Figure 14:
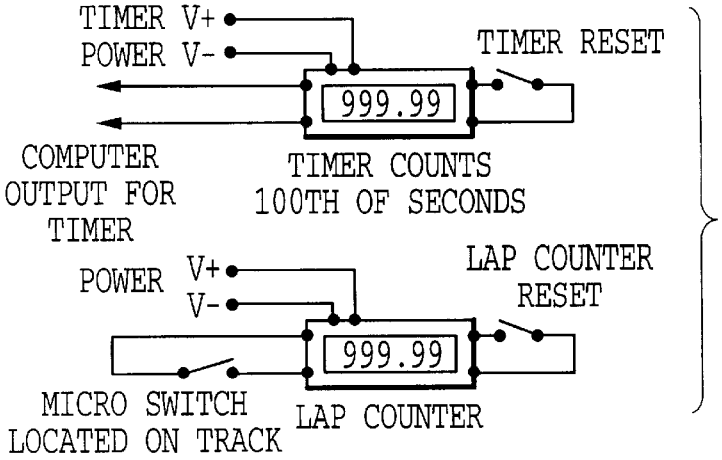
Figure 15:
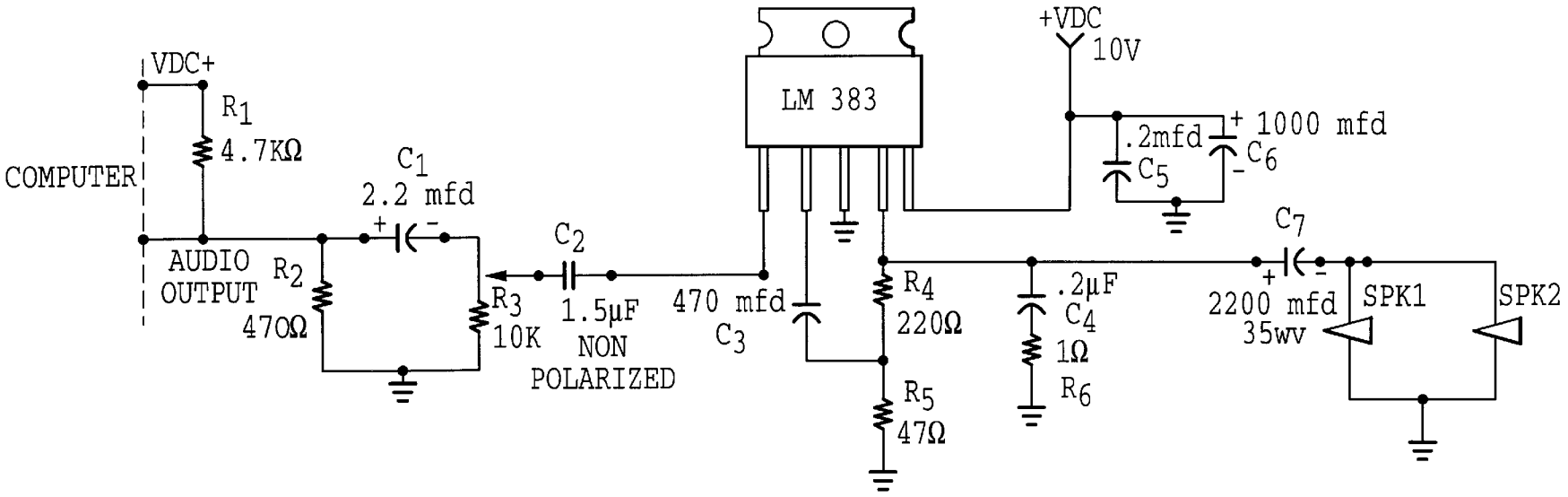

FIG. 12 shows an electric circuit for a coin switch and key switch arrangement that permits the game computer to be operated either by inserting coins or by operating a bypass push button to add to the computer counter. FIG. 13 shows an electric circuit for controlling and supplying power to the electric motor on the trolley. FIG. 14 shows an electric circuit for a timer display and for a lap counter display, which are provided at each corner of the game table. FIG. 15 shows an audio amplifier circuit for providing the sound system of the roping game.

The electric circuits shown in FIGS. 10 to 15 are circuits whose operations are apparent to those having ordinary skill in the art. The circuits shown in FIGS. 10 to 15 are only one example of the circuits that can be used and other types of circuits that provide the same functions may alternatively be used.

An exemplary operation of the roping game and practice device will now be explained with reference to the electric circuits and the other components described above.

As coins or tokens are added, the game computer gives an analog signal or tone of a beep and counts the coins. For each coin or token put in, the computer allows, for example, either 3 or 4 laps of the steer. The computer can be capable, for example, of counting up to 60 coins and giving 180 to 240 laps, depending on how it is programmed. The game will not start until at least four coins are put in.

After putting in the right amount of coins, a player can push a normally open switch, SW1, which is located at player number one's corner to start the game.

The game computer A then plays a few notes of a pleasant tune. At the end of the tune, one of the computer outputs goes from 0 volts to a positive 5 VDC and supplies power to the input of a solid state relay (SSR). The SSR has no electrical contacts inside but does have a silicon controlled rectifier (SCR) that acts like a 120 VAC switch when power is applied to the input side. When the SCR has +5 VDC on the input side, the output 120 VAC is supplied to the slip ring electric distributor 42 that provides the 120 VAC to power the gear reduced electric motor 37 mounted on the trolley 30.

As the trolley 30 moves forward, arch switch number one, which is connected to one of the computer's inputs, opens. The computer then sends a beep tone to an audio amplifier and starts player number one's digital timer. The timer continues to run until player number one ropes the steer's rear legs and dallies the rope around the dally horn 21, which has a switch HSW 1 in it. As the rope tightens, HSW 1 (which is connected to another of the computer's inputs) closes the computer, stops the timer, and plays a tune to reward the roper.

Should the roper fail to activate HSW 1, the computer internal timer continues to run and gives player number one a penalty of approximately 3.5 added seconds total time. The computer stops player number one's timer and plays a couple of notes of an unpleasant tune.

The steer 15 then continues on to corner number two. As the trolley 30 moves forward, arch switch two, which is connected to one of the computer's inputs, opens. The computer then sends a beep tone to the audio amplifier and starts player number two's digital timer. The timer continues to run until player number two ropes the steer's rear legs and dallies the rope around the dally horn, which has a switch HSW 2 in it. As the rope tightens, HSW 2, which is connected to another of the computer's inputs, closes the computer, stops the timer and plays a tune to reward the roper.

Should the roper fail to activate HSW 2, the computer internal timer continues to run and gives the player a penalty of approximately 3.5 added seconds total time. The computer stops player number 2's timer and plays a few notes of the unpleasant tune.

The steer continues on to corners three and four, and the above sequence is repeated in each corner.

Each time the steer trolley hits arch switch number one, the computer counts one lap and continues until the lap counting part of the computer is satisfied and the game is stopped until more money is put in or the key switch is operated to bypass the coin switch and add to the computer's counter.

While preferred embodiments of the present invention have been described above and illustrated in the accompanying drawings, various modifications and changes to the preferred embodiments have also been contemplated by the inventors. For example, any mechanical or electronic switch device remotely or on the game table that would start/stop a timer, whether an analog or digital clock, in a roping game for fun or competition can be used. The game can also be controlled using electronic signaling with R.F. frequencies, infrared or any other type of device that would allow the game to be remotely run.

The trolley drive can be replaced by any suitable electrical or mechanical steer moving device made of rubber or spring type material or gears. The display panels for the timer and lap counter can be in the form of any analog or digital device, such as LED, LCD, plasma, video CRT, flat screen, or any other type display. The steer can be made to move left and right, as well as up and down. The table or floor game can be in various forms, including a bargain machine with one arch or corner, an amateur roper with two arches or corners, a semi-pro roper with three arches or corners, or a pro roper with arches or corners for four or more corners and arches for several ropers at a time. In a less preferred form, the table or floor game can also be in a circular or oval shape without corners.

When the number of corners changes from the four corners of the preferred embodiment, the track design and the way the steer is moved will also change. For example, any one or a combination of the following can be used to move the steer: a threaded shaft, a cable, a chain, a rope, a wire, or a track. The drive means can be in the form of a reversible or nonreversible gear motor or any other suitable drive means that functions to move the steer from one corner arch to another corner arch. It is also contemplated that the steer can be guided in a closed-loop path by means other than a track, as in the preferred embodiment. For example, the steer can ride on a wheeled unit (e.g., a three wheel tricycle unit) with rubber tires or the like which engage a floor or table surface directly.

The movable object for roping can be in various other forms besides the likeness of a steer. However, to simulate a real life roping event, it is preferred that the movable object be made in the likeness of at least the horns and legs of a steer.

Instead of a coin counter, the game controller can be equipped with an electrical or mechanical system that accepts coins, money, or credit cards of any kind, or it can include only an on/off switch to start and stop the game. As explained above, the preferred embodiment has a key switch that can be set in one position to count coins, and in another position to allow a person to play by pushing a switch that simulates the insertion of a coin. This enables a game operator to accept money from players directly and operate the game using a key. The game controller also preferably includes a totaling electrical/mechanical non-resetable lap counter to show the owner or vendor how many laps the steer has completed.

The steer on certain models of the game can be equipped with lights for eyes and lights on the rear legs. The steer can also be equipped with lights that blink on and off when the steer is set in its hopping mode.

The surface of the table can be made to have the color and texture of dirt. The rough surface or texture of dirt will make it more difficult for the steer to be roped, and will make the game even more similar to a rodeo roping competition, which usually takes place in a dirt arena.

The roping game and practice device according to the present invention can be played by both right- and left-handed players. While left-handed players generally cannot rope the steer quite as fast as right-handed players if the steer is moving counterclockwise around the table, they can often dally the rope quicker. The dally (i.e., wrapping of the rope around the horn) can be made around the horn in either direction. If the steer travels around the game table in a counterclockwise direction, a left-handed player usually must allow the steer to move through the arch only a few inches further than a right-handed player before a heel loop can be thrown. Left-handed and right-handed players can, therefore, be very competitive with each other.

It will be appreciated that the present invention is not limited to the exact construction that has been described above and illustrated in the accompanying drawings, and that various modifications and changes can be made without departing from the scope and spirit thereof. It is intended that the scope of the invention only be limited by the appended claims, including all equivalents to the elements set forth in the claims.

The invention claimed is:

1. A roping game and practice device, comprising:

a dally horn:

a movable object adapted to be roped;

a timer for determining the length of time a player takes to rope said movable object;

a first switch in communication with said timer for starting said timer; and a second switch in communication with said timer for stopping said timer, said second switch being responsive to a player's rope being wrapped around said dally horn to stop said timer.

2. The roping game and practice device according to claim 1, wherein said first switch is arranged to automatically start said timer when said movable object becomes available for a player to rope.

3. The roping game and practice device according to claim 1, wherein said dally horn has a portion around which said player's rope is wrapped, and a wall of said portion is movable in response to the player's rope being wrapped around the dally horn, said second switch being responsive to movement of said wall to stop said timer.

4. The roping game and practice device according to claim 1, further comprising an arch structure under which said movable object passes, said first switch being arranged to be automatically triggered to start said timer when said movable object passes under said arch structure.

5. The roping game and practice device according to claim 4, wherein said arch structure has a first position in which the arch structure is folded against a surface of the game to facilitate storage and transport of the game, and a second position in which the arch structure extends upwardly from the surface to enable the movable object to pass under the arch structure.

6. The roping game and practice device according to claim 4, further comprising a closed-loop path about which said movable object travels, said closed-loop path having a plurality of arch structures at spaced locations extending over the path.

7. The roping game and practice device according to claim 6, wherein said closed-loop path has a plurality of corners, and one of said arch structures is provided adjacent each of said corners.

8. The roping game and practice device according to claim 4, wherein said dally horn is supported on said arch structure.

9. The roping game and practice device according to claim 4, wherein said movable object is supported on a wheeled trolley that travels along a closed-loop track, said wheeled trolley has a switch contacting member extending therefrom, said switch contacting member being positioned so as to engage said first switch when said wheeled trolley passes beneath said arch.

10. The roping game and practice device according to claim 1, further comprising an audio means for making a sound when said timer starts, for playing a first selected tune when a player successfully ropes the movable object, and for playing a second selected tune if a player fails to rope the movable object within a predetermined time or distance of movement.

11. A roping game and practice device, comprising:

a rope having a a loop at one end for roping;

a movable object adapted to be roped by said rope; and a closed-loop path that lies within a generally horizontal plane around which said movable object travels, said closed-loop path having at least one corner for making said movable object change a direction of movement abruptly.

12. The roping game and practice device according to claim 11, wherein said closed-loop path has a generally square shape with four corners.

13. The roping game and practice device according to claim 11, further comprising an arch at each corner through which said movable object passes.

14. The roping game and practice device according to claim 11, further comprising a means for counting a number of times the movable object travels around said path, and a means for stopping said movable object after the movable object travels around the path a predetermined number of times.

15. The roping game and practice device according to claim 11, further comprising a means for moving a portion of said movable object in an up-and-down manner while said movable object travels around said path.

16. The roping game and practice device according to claim 11, further comprising a table surface positioned above a closed-loop track for guiding said movable object around said path, said table surface having a slot through which said movable object is connected to a trolley that travels around said closed-loop track.

17. The roping game and practice device according to claim 16, wherein said table surface has a rough surface texture resembling a surface texture of a rodeo arena to simulate a rodeo roping environment.

18. The roping game and practice device according to claim 16, wherein said game is supported on legs that are vertically adjustable to permit a height of said table surface to be adjusted.

19. The roping game and practice device according to claim 11, further comprising at least one manual scoring system mounted on said game to keep track of each player's penalty score.

20. The roping game and practice device according to claim 11, further comprising a means for varying a speed of movement of said movable object around said closed-loop path.

21. The roping game and practice device according to claim 11, further comprising a wheeled trolley for supporting said movable object, said trolley having a drive motor mounted thereon for driving a drive wheel in engagement with a closed-loop track for guiding said movable object around said path.

22. The roping game and practice device according to claim 21, wherein said closed-loop track comprises a lower track and an upper track, said wheeled trolley comprises at least one wheel that engages said lower track and at least one wheel that engages said upper track, and at least one of said wheels is driven by a motor supported on said wheeled trolley.

23. The roping game and practice device according to claim 22, wherein said wheeled trolley has a pair of wheels that engage said lower track and a single wheel that engages said upper track, and a structure for biasing said upper and lower wheels into engagement with said upper and lower tracks, respectively.

24. The roping game and practice device according to claim 23, wherein a front wheel of said pair of wheels that engage said lower track is wider than a rear wheel of said pair of wheels that engage said lower track to facilitate movement of said trolley around a corner of the closed-loop track.

25. The roping game and practice device according to claim 21, further comprising a slip ring assembly positioned in an approximate center of the closed-loop track, said slip ring assembly having a stationary electrical input and a rotating electrical output, at least one conductive member extending from said output to the drive motor supported on said trolley for supplying electrical power to said trolley.

26. The roping game and practice device according to claim 25, further comprising a guiding arrangement for guiding said wheeled trolley around said closed-loop track, said guiding arrangement comprising a guide member mounted to a rotating shaft of said slip ring assembly, a support member slidably supported by said guide member and pivotally connected to said wheeled trolley, a first resilient member extending between said guide member and said support member for biasing said support member toward said wheeled trolley, an offset member fixed to said support member and extending away from a longitudinal axis of the support member, and a second resilient member extending from a free end of the offset member to a point on said wheeled trolley forward of the pivotal connection of the support member to the wheeled trolley.

27. A roping game and practice device comprising;

a movable object adapted to be roped;

a closed-loop path around which said movable object travels, said closed-loop path having at least one corner for making said movable object change a direction of movement abruptly;

an arch at each corner through which said movable object passes; and a dally horn mounted on said arch, said dally horn being adapted to have a rope wrapped therearound upon roping the movable object with the rope.

28. The roping game and practice device according to claim 27, further comprising a timer and switch arrangement for automatically determining a length of time from when the movable object passes through said arch until a player ropes the movable object and wraps the rope around the dally horn.

29. A roping game and practice device comprising:

amovable object adapted to he roped; and a closed-loop path around which said movable object travels, said close-loop path having at least one corner for making said movable object change a direction of movement abruptly;

wherein said movable object is shaped as a steer with rear legs for roping, said rear legs being pivotally mounted to a body of said steer so as to move rearwardly when a player's rope is looped around said rear legs and tensioned, and a spring means for biasing said rear legs in a forward direction to pivot said rear legs to a forward position when the player's rope is slipped off of said rear legs.

30. The roping game and practice device according to claim 29, further comprising a means for moving said steer in a hopping manner as said steer travels around the path, said moving means comprising an electrical actuator carried by a wheeled trolley for supporting said steer and operatively connected to said steer, said steer being movable by said electrical actuator about a pivot connection near a front portion of said steer to cause said rear legs of the steer to move upward and downward.

31. The roping game and practice device according to claim 30, wherein said steer has front legs that are pivotally mounted to the body of the steer, a spring means for biasing the front legs in a rearward direction, said electrical actuator being connected to said steer through a tension member and pulley arrangement that causes the front legs of the steer to pivot forwardly when a tension is applied by the actuator to the tension member and causes the steer to pivot about said pivot connection to cause the rear legs of the steer to move upward and downward.

32. A roping game comprising:

a movable object adapted to be roped;

a closed-loop path about which said movable object travels;

a first means for determining if a player successfully ropes the movable object within a predetermined time or distance of movement; and an audio means in communication with said first means for automatically making a first selected sound when a player successfully ropes the movable object, and for automatically making a second selected sound if a player fails to rope the movable object within said predetermined time or distance of movement.

33. The roping game according to claim 32, further comprising a means for making a third selected sound when a timer starts, thereby indicating to a player that the movable object is ready to be roped.

* * * * *